US005224421A

United States Patent [19]

Doherty

[11] Patent Number: 5,224,421

[45] Date of Patent: Jul. 6, 1993

[54] METHOD FOR COLOR ADJUSTMENT AND CONTROL IN A PRINTING PRESS

[75] Inventor: Neil Doherty, Portsmouth, N.H.

[73] Assignee: Heidelberg Harris, Inc., Dover, N.H.

[21] Appl. No.: 875,092

[22] Filed: Apr. 28, 1992

[51] Int. Cl.[5] ..... B41F 31/04

[52] U.S. Cl. ..... 101/211; 101/365; 101/DIG. 45

[58] Field of Search ..... 101/483, 484, 211, 365, 101/DIG. 45, DIG. 47, 170; 364/526, 470, 471, 235; 356/408, 425, 429; 250/571, 559

[56] References Cited

U.S. PATENT DOCUMENTS

| | | | |
|---|---|---|---|
| 3,185,088 | 5/1965 | Norton | 101/DIG. 45 |
| 4,233,663 | 11/1980 | Sugawara et al. | 101/DIG. 45 |
| 4,901,254 | 2/1990 | Dolezalek et al. | 364/526 |
| 4,967,379 | 10/1990 | Ott | 364/526 |
| 4,975,862 | 12/1990 | Keller et al. | 364/526 |
| 4,992,861 | 2/1991 | D'Errico | 358/75 |

FOREIGN PATENT DOCUMENTS

| | | |
|---|---|---|
| 0228347B1 | 7/1987 | European Pat. Off. . |
| 0255924A2 | 2/1988 | European Pat. Off. . |
| 2-32566 | 8/1982 | Japan . |

OTHER PUBLICATIONS

R. Brand and T. Celio, "A New Color Control System For Gravure", ERA annual meeting 1987.

Tino Celio and Rudolf Brand, "On-Press Colorimetric Control For Gravure Publication And Packaging Presses", dated Apr. 1988.

Berthold K. P. Horn, "Exact Reproduction of Colored Images"—*Computer Vision, Graphics and Image Processing*, Feb. 3, 1983, pp. 135-167.

Harris Graphics Densicontrol Preset Inker System Brochures.

*Primary Examiner*—J. Reed Fisher

*Attorney, Agent, or Firm*—Kenyon & Kenyon

[57] ABSTRACT

A method for color adjustment and control in a printing press wherein the density spectra of individual process colors as well as the density spectrum of the color of paper are stored with given fractional percentages. The density spectra of at least one measuring point per ink zone on a printing copy and at respective points on a printed product are then measured. The density spectra measured on the printing copy and the printed product are then expressed as a linear combination of the density spectra of the individual process colors and the density spectrum of the color of the paper multiplied by fractions, the fractions being calculated so that the density spectra of the printing copy and the printed product are approximated through the linear combination. In the case of a deviation of the fractions between the printed product and the printing copy, the positions of the ink keys are adjusted so that a match of the density spectra is achieved.

26 Claims, 1 Drawing Sheet

METHOD FOR COLOR ADJUSTMENT AND CONTROL IN A PRINTING PRESS

FIELD OF THE INVENTION

The present invention relates to a method for color adjustment and control in a continuous printing press, whereby ink feed takes place through adjustment of ink feed elements in the printing press.

BACKGROUND OF THE INVENTION

The control of ink feed in a continuous printing process is an effective means for improving the quality of a printed image. With ink feed control it is the aim to achieve a high degree of conformity between the target colors of a printing copy, e.g., an "o.k. sheet" printed in the machine, an original, a proof, or in some instances, printing plates used for applying individual process colors, and the colors of a printed product from a production run.

Spectral measurements of emissions from color measuring fields or color bars, the mathematical conversion of these measured values into colormetric values, and further into control data for adjustment of ink feed elements of a printing press have become known from European Patent No. 0 228 347. To conform or color match a printing copy and a printed product, the spectral emissions of color measuring fields or color bars from the printing copy and the printed product are measured. From the measured emissions, the color coordinates of a reference color spot on the printing copy and the respective color coordinates of an actual color spot on the printed product are determined. Through a comparison of the emissions and the color coordinates of the reference color spot with the respective emissions and color coordinates of the actual color spot, the color difference between the reference color spot and the actual color spot is determined. This color difference is converted into change values for layer thicknesses of individual printing inks. The control of the ink feed elements themselves takes place in accordance with the determined change values of layer thicknesses of the individual printing inks so that the total color difference between the reference color spot and the actual color spot becomes minimal.

Japanese Patent No. 2-32566 is directed to a device for determining dot area coverages of colored printed products. Screen densities of measuring points on the colored printed products are measured through red, green, and blue filters. From the measured screen densities the area coverages in the process colors cyan, magenta, and yellow are determined by the Murray-Davis formula. The theoretical screen densities are then determined from the area coverages by the Yule-Nielsen formula. The theoretical screen densities are compared with the measured screen densities by an iterative method. The screen densities and area coverages are adjusted so that a deviation between the theoretical screen density and the measured screen density lies within a given tolerance.

The device disclosed in Japanese Patent No. 2-32566 is limited, however, to the three standard printing inks, cyan, magenta, and yellow. A color control of the color black or special colors of printing ink is not provided for with the method described therein.

OBJECTS AND SUMMARY OF THE INVENTION

It is an object of the present invention to provide a method for color adjustment and control which can be utilized for all colors of printing ink.

The present invention provides a method for adjusting and controlling color in a printing press, comprising the steps of: storing density spectra of individual process colors and the color of paper with given fractional percentages; measuring density spectra of at least one measuring point per ink zone on a printing copy and at respective points on a printed product; expressing the density spectra measured on the printing copy and the printed product as a linear combination of the density spectra of the individual process colors and the color of the paper multiplied by fractions, the fractions being calculated so that the density spectra measured on the printing copy and the printed product are approximated through the linear combination; and adjusting ink feed by setting the positions of ink keys in individual printing units so that a match of the density spectra is achieved in the case of a deviation of the fractions between the printed product and the printing copy.

The present invention also provides for selection of measuring points either by an operator or automatically according to given criteria. These measuring points advantageously are chosen so as to include all the colors used in the printing process.

The present invention is not limited to use with color emission measurements from measuring fields in a print control strip. The invention also works well by taking measurements from within the printed image. This has the advantage of saving space and paper.

Another advantage of the present invention is that measurements at chosen measuring points may be taken when the printing process has reached a steady-state condition.

Another advantage of the present invention is that it can be utilized on line as well as off-line. With the present invention it is possible to measure the printed image at the measuring points while the printing machine is running. A specially adapted spectrophotometer such as the Gretag SPM700-system could be used for this purpose. This has the advantage of taking measurements instantaneously without having to wait for the printed product to exit the printing machine. However, such a spectrophotometer is expensive. Alternatively, the present invention works well off-line using a less expensive hand-held spectrophotometer for measuring the printed image at the measuring points on a known color control console.

Other advantages and characteristics of the present invention will become apparent from the detailed description and drawing that follow.

DETAILED DESCRIPTION

Figure 1:
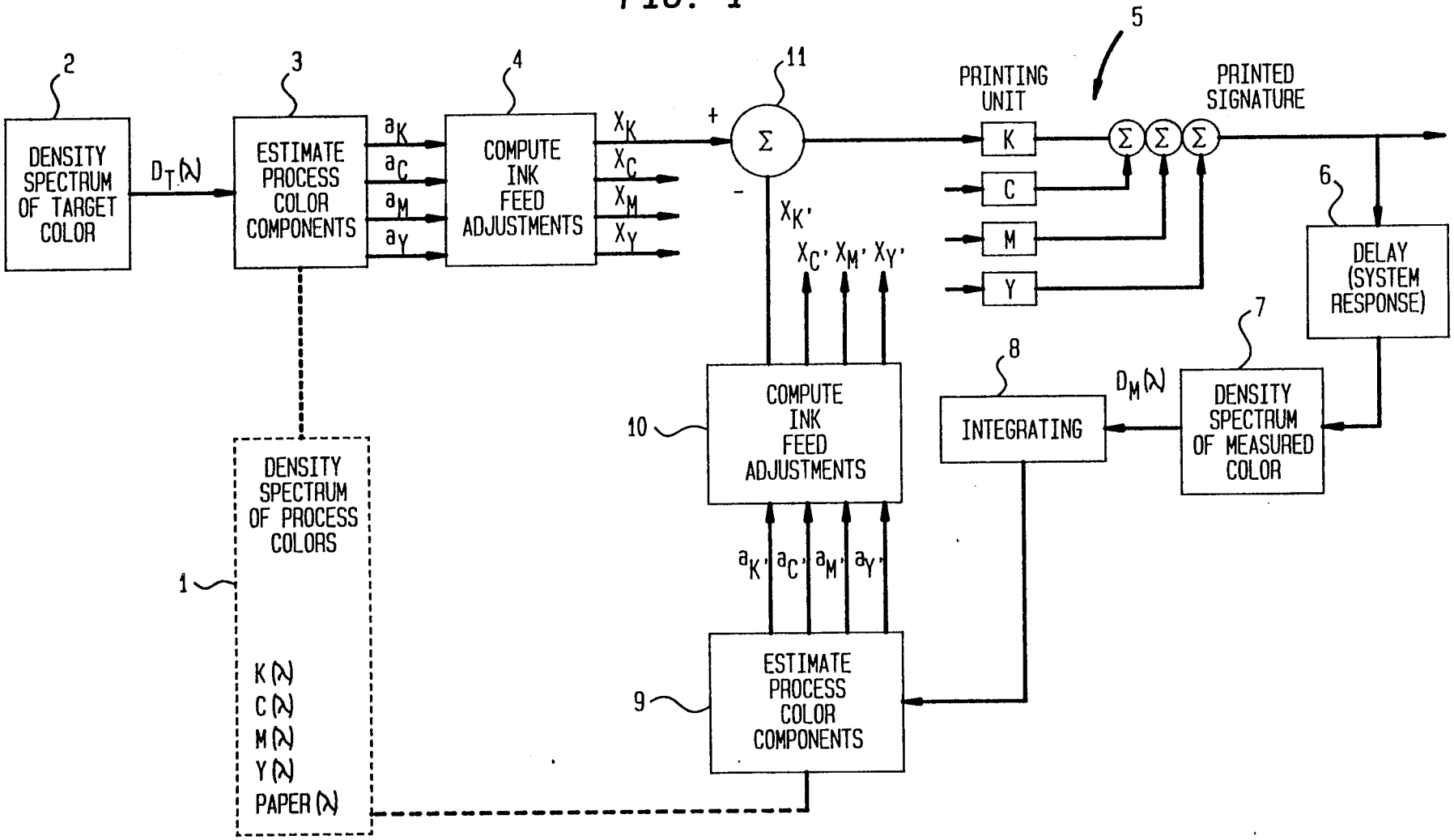
FIG. 1 is a block diagram illustrating the execution of the present invention for color control.

The present invention may be understood by reference to FIG. 1 which illustrates in block format the execution of the inventive method. The computing operations which are to be performed in the individual blocks are preferably executed by means of a computer. This computer also controls the positions of the ink keys in the individual printing units in accordance with calculated adjustment values $X_j$ (where j is individual process colors).

Before beginning the printing process, the density spectra $D_j(\lambda)$ of the individual process colors (where $\lambda$ is the wavelength of the radiant energy emitted by the individual process colors at a given measuring point) with given fractional percentages as well as the density spectrum $P(\lambda)$ of the color of paper with a given fractional percentage are determined and stored in a storage device, as illustrated in Block 1. The density spectra may be measured with a spectrophotometer which measures color density at selected points in the visible range of the spectrum.

The density spectra $D_j(\lambda)$ of the printing inks to be used, e.g., the standard colors cyan, magenta, yellow and black, as well as, specialty colors showing the same coverage are known to vary depending on the source of ink manufacture. Similarly, the density spectrum $P(\lambda)$ of the color of the paper varies depending on the source of manufacture and grade. Therefore, whenever printing inks of a different manufacture or paper of a different manufacture and/or different grade are used to finish an order, or for a repeat order, the density spectra $D_j(\lambda)$ and $P(\lambda)$ are preferably remeasured. However, since the density spectra $D_j(\lambda)$ and $P(\lambda)$ of the process colors and paper are stored in the storage device as depicted in Block 1, when printing inks of the same manufacture and paper of the same manufacture and grade are reused these density spectra need not be remeasured.

Once the process data has been determined and stored, the density spectrum $D_T(\lambda)$ is measured from at least one measuring point per ink zone on a printing copy, as illustrated in Block 2. In order to avoid errors which can result from the similarity of the density spectra of some process colors, for example, the color black and the specialty color silver, the fractional percentages of the individual process colors can be detected in advance by a printing plate scanner. This information is taken into account in Block 3 of the diagram.

Next, the measured density spectrum $D_T(\lambda)$ is expressed as a linear combination of the density spectra $D_j(\lambda)$ of the individual process colors multiplied by fractions $a_j$, and the density spectrum $P(\lambda)$ of the color of the paper multiplied by a fraction $a_p$. The fractions $a_j$ and $a_p$ represent the percentage of each individual process color and of the color of the paper at a given measuring point in a given ink zone.

Thus, the density spectrum $D_T(\lambda)$ may have the following form:

$$D_T(\lambda) = \sum_{j=1}^{m} a_j * D_j(\lambda) + a_p * P(\lambda) \tag{1}$$

where the values $D_T$, $D_j$ and P are vectors since the measured density spectra are composed of discrete measuring points, $a_j$ and $a_p$ are as defined above, and m is the number of process colors.

In component-presentation, when the density spectrum is determined at n measuring points and the standard colors black (K), magenta (M), cyan (C), yellow (Y) as well as the color of the paper (P) are used, the formula reads as follows:

$$\begin{bmatrix} D_T(\lambda_1) \\ * \\ * \\ * \\ D_T(\lambda_n) \end{bmatrix} = \begin{bmatrix} K(\lambda_1) & M(\lambda_1) & C(\lambda_1) & Y(\lambda_1) & P(\lambda_1) \\ K(\lambda_2) & * & * & * & * \\ * & * & * & * & * \\ * & * & * & * & * \\ K(\lambda_n) & M(\lambda_n) & C(\lambda_n) & Y(\lambda_n) & P(\lambda_n) \end{bmatrix} \begin{bmatrix} (a_K) \\ (a_M) \\ (a_C) \\ (a_Y) \\ (a_P) \end{bmatrix} \tag{2}$$

In a preferred embodiment of the present invention, the fractions $a_j$ of the individual process colors used in the printing process are calculated by means of the method of the least squares error solution, as illustrated in Block 3. Where the color of the paper is essentially white, the fraction $a_p$ need not be calculated since only the fractions $a_j$ will be utilized in adjusting the positions of the ink keys. However, where the color of the paper is a color other than white, the fraction $a_p$ should also be calculated using the least squares error solution and be taken into account in adjusting the positions of the ink keys.

The above linear combination (2) can be expressed in the form:

$$b = \underline{A} * X \tag{3}$$

where b represents the vector $D_T$, A represents the matrix $D_j$ at n measuring points, and X represents the vector $a_j$, and where necessary $a_p$.

The vector X which minimizes the squared equation $$(\underline{A} * X - b)^2 \tag{4}$$

reads $$X = (\underline{A}^{t*} \underline{A})^{-1*} A^{t*} b \tag{5}$$

where $\underline{A}^t$ represents the matrix A transformed.

The vector X and the components of the vector X, that is, the fractions $a_j$ can easily be determined therefrom. The present invention also provides that the fractions $a_j$ can be measured directly off the printing plates. A device such as the Densicontrol TM Preset Inker Module manufactured by Harris Graphics, Inc. can be used for this purpose. With such a device the printing plates are placed on a scanning table whereon they are scanned by a scanner arm moving across the table. The scanned data is stored and then transformed into ink key adjustments which are used to automatically preset the ink keys and fountain rolls on the printing press.

From the fractions $a_j$, adjustment values $X_K$, $X_C$, $X_M$, and $X_Y'$ for ink keys in individual printing units can be calculated, as illustrated in Block 4. The adjustment values $X_K$, $X_C$, $X_M$, and $X_Y'$ are dependent on press design and coverage on the printing plates. These two factors determine the relationship between ink key position and printed ink film. This relationship can be determined analytically using the fractions $a_j$ and/or experimentally depending on various factors influencing ink feed.

In a four-color offset printing press, the ink keys are set using the adjustment values, $X_K$, $X_C$, $X_M$, and $X_Y'$. A sheet or web passing through the printing press is successively printed on with inks in the colors black (K), cyan (C), magenta (M), and yellow (Y) in the individual printing units, as illustrated in Block 5.

In offset printing, the print quality is not determined by an optimized color control alone. It is just as important to have an optimized dampening control—this applies at least to wet offset printing. A satisfactory print quality can only be reached when there exists an even balance between the ink and the dampening fluid being fed.

An optimal contrast and therewith a very good print quality can be achieved just at the border of smearing. This smear border is defined in that the dampening fluid being fed is metered in an amount that the non-printing areas begin to accept ink.

Thus, the smear border represents a critical border in offset printing. If on the one hand, the amount of dampening fluid being fed is insufficient, scumming occurs in the non-printing areas and waste is printed. If on the other hand, the amount of dampening fluid being fed is too much, the contrast becomes worse and thereby the print quality, which can lead to water marks in the printed image. Here also, waste is printed.

With the color control method according to the present invention it is preferable that the dampening fluid feed is arranged in a way that the printing process can be controlled close to the smear border.

After the ink keys have been set, a certain time passes before the printing process has stabilized itself, as illustrated in Block 6. Once the printing process has stabilized, the density spectrum $D_M(\lambda)$ is measured on the printed product at respective points corresponding to those points which were previously measured on the printing copy, as illustrated in Block 7.

Preferably, several measurements are taken at several measuring points of the ink zones on the printed product, and that of these measured values an integrated value is formed. Furthermore, preferably measurements are taken on several printed products, and that of these measured values an integrated measured value is formed. This way, short-term variations in the ink feed which, for example, can be caused by the ductor stroke or other dynamic effects are filtered off. These calculations are executed in Block 8 of the diagram.

The density spectrum $D_M(\lambda)$ measured on the printed product is then expressed as a linear combination of the density spectra $D_j(\lambda)$ of the individual process colors multiplied by fractions $a_j'$, and the density spectrum $P(\lambda)$ of the color of the paper multiplied by a fraction $a_p'$. Here also, the method of the least squares error solution is used to calculate the fractions $a_j'$, and where necessary the fraction $a_p'$, as illustrated in Block 9.

Once determined, the fractions $a_j'$ are used to determine adjustment values $X_K'$, $X_M'$, $X_C'$, and $X_Y'$ for the ink feed in the individual printing units, as illustrated in Block 10. The adjustment values $X_K'$, $X_M'$, $X_C'$, and $X_Y'$ values can also be determined experimentally depending on various factors influencing ink feed.

Once the adjustment values $X_K'$, $X_M'$, $X_C'$, and $X_Y'$ are determined they are compared with the respective reference values $X_K$, $X_M$, $X_C$, and $X_Y'$. This comparison takes place in the summator in Block 11 of the diagram. When there is a deviation between the actual positions and the reference positions of the ink keys, the operator is given the opportunity to adjust the positions of the ink keys so that the density spectrum $D_M(\lambda)$ will more closely approximate the density spectrum $D_T(\lambda)$. This step can also be performed automatically. Alternatively, the positions of the ink keys can be adjusted based on a direct comparison of the fractions $a_j'$ with the fractions $a_j$. Furthermore, various factors influencing the ink feed, such as the ink tack or the temperature are also taken into account in adjusting the positions of the ink keys.

Finally, it is preferable that the inventive method be iterative so that the printing process is continuously monitored and the positions of the ink keys adjusted as needed to maintain sufficient quality of the printed products.

I claim:

1. A method for adjusting and controlling color in a printing press comprising the steps of:

storing density spectra of individual process colors and the color of paper with given fractional percentages;

measuring density spectra of at least one measuring point per ink zone on a printing copy and at respective points on a printed product;

expressing the density spectra measured on the printing copy and the printed product as a linear combination of the density spectra of the individual process colors and the color of the paper multiplied by fractions, the fractions being calculated so that the density spectra measured on the printing copy and the printed product are approximated through the linear combination; and adjusting ink feed by setting the positions of ink keys in individual printing units so that a match of the density spectra is achieved in the case of a deviation of the fractions between the printed product and the printing copy.

2. The method according to claim 1, further comprising the step of balancing the ink feed with a dampening fluid.

3. The method according to claim 2, wherein the dampening fluid is arranged in a way that the printing process can be controlled near the smear border.

4. The method according to claim 1, wherein the fractions are calculated by means of the method of least squares error solution.

5. The method according to claim 4, wherein the fractions are used to calculate adjustment values which are used in setting the positions of the ink keys in the individual printing units.

6. The method according to claim 5, wherein the adjustment values are determined experimentally depending on various factors influencing the ink feed.

7. The method according to claim 1, wherein an operator is given the opportunity to set the positions of the ink keys in the individual printing units.

8. The method according to claim 1, wherein the positions of the ink keys in the individual printing units are set automatically.

9. The method according to claim 1, wherein the measuring points are the measuring fields of a print control strip.

10. The method according to claim 1, wherein the measuring points are measuring fields within the printed subject of the printed product or the printing copy.

11. The method according to claim 1, wherein selection of the measuring points takes place automatically according to given criteria.

12. The method according to claim 1, wherein selection of the measuring points takes place through an operator.

13. The method according to claim 1, wherein a measurement on the printed product takes place only after a steady-state condition in the printing press is reached.

14. The method according to claim 1, wherein the measuring points are measured spectrophotometrically during operation of the printing press.

15. The method according to claim 1, wherein the measuring points of the printed product are measured spectrophotometrically off-line.

16. The method according to claim 1, wherein the density spectra are measured at several measuring points per ink zone on the printed product and an integrated value is formed.

17. The method according to claim 1, wherein the density spectra are measured on various printed products and an integrated measured value is formed.

18. The method according to claim 1, wherein the density spectra of the individual process colors and the color of the paper are measured using a spectrophotometer.

19. The method according to claim 1, wherein the process colors are black, cyan, magenta, and yellow.

20. The method according to claim 1, wherein the process colors are black, cyan, magenta, yellow, and at least one specialty color.

21. The method according to claim 1, wherein the printing copy is a printed product printed in the printing press.

22. The method according to claim 1, wherein the printing copy is an original.

23. The method according to claim 1, wherein the printing copy is a proof.

24. The method according to claim 1, wherein the printing copy is printing plates used for applying the individual process colors.

25. The method according to claim 1, wherein the fractions of the individual process colors are measured directly off the printing plates used in applying the individual process colors.

26. The method according to claim 25, wherein the fractions are used to adjust the initial positions of the ink keys in the individual printing units before the printing process begins.

* * * * *

UNITED STATES PATENT AND TRADEMARK OFFICE

CERTIFICATE OF CORRECTION

PATENT NO. : 5,224,421

DATED : July 6, 1993

INVENTOR(S) : DOHERTY, Neil

It is certified that error appears in the above-identified patent and that said Letters Patent is hereby corrected as shown below:

Column 4, lines 27 and 38, change "A" to --A--.

Signed and Sealed this

Twenty-ninth Day of March, 1994

*Attest:*

Bruce Lehman

BRUCE LEHMAN

*Attesting Officer*

*Commissioner of Patents and Trademarks*